US005327750A

United States Patent [19]

Speich

[11] Patent Number: 5,327,750

[45] Date of Patent: Jul. 12, 1994

[54] WARP KNITTING MACHINE, ESPECIALLY CROCHET GALLOON MACHINE

[75] Inventor: Francisco Speich, Oberfrick, Switzerland

[73] Assignee: Textilma AG, Oberfrick, Switzerland

[21] Appl. No.: 924,006

[22] PCT Filed: Dec. 24, 1991

[86] PCT No.: PCT/CH91/00278

§ 371 Date: Sep. 22, 1992

§ 102(e) Date: Sep. 22, 1992

[87] PCT Pub. No.: WO92/13127

PCT Pub. Date: Aug. 6, 1992

[30] Foreign Application Priority Data

Jan. 24, 1991 [CH] Switzerland ..... 209/91-7

[51] Int. Cl.[5] ..... D04B 27/26

[52] U.S. Cl. ..... 66/207; 66/205; 139/55.1

[58] Field of Search ..... 66/203, 204, 205, 207, 66/214, 64 R; 139/55.1, 82, 85

[56] References Cited

U.S. PATENT DOCUMENTS

| | | | |
|---|---|---|---|
| 3,678,711 | 7/1972 | Schneider | 66/205 |
| 3,729,954 | 5/1973 | Ducol | 66/205 |
| 3,835,894 | 9/1974 | Speich | 139/55.1 |
| 4,139,997 | 2/1979 | Riesen | 66/207 |
| 4,312,196 | 1/1982 | Englert | 66/207 |
| 4,414,826 | 11/1983 | Mista et al. | 66/207 |
| 4,458,508 | 7/1984 | Englert et al. | 66/207 |
| 4,614,095 | 9/1986 | Porat | 66/207 |

FOREIGN PATENT DOCUMENTS

| | | | |
|---|---|---|---|
| 2260666 | 6/1974 | Fed. Rep. of Germany | 66/64 R |
| 3064558 | 3/1991 | Japan | 66/205 |
| 513132 | 5/1976 | U.S.S.R. | 66/205 |

*Primary Examiner*—Clifford D. Crowder
*Assistant Examiner*—John J. Calvert
*Attorney, Agent, or Firm*—Anderson Kill Olick & Oshinsky

[57] ABSTRACT

A control arrangement for the shifting movement of at least one guide bar (4) contains a pick-off gear (10) against which the guide bar is pretensioned. The pick-off gear (10) has a plurality of thrust elements (8, $\mathbf{8_1}$, $\mathbf{8_2}$, $\mathbf{8_3}$) connected one behind the other, between which displacement elements ($\mathbf{12_1}$, $\mathbf{12_2}$, $\mathbf{12_3}$, $\mathbf{12_4}$) are arranged, the thrust elements (8, $\mathbf{8_1}$, $\mathbf{8_2}$, $\mathbf{8_3}$) being supported on the radial cams (34) of the displacement elements ($\mathbf{12_1}$, $\mathbf{12_2}$, $\mathbf{12_3}$, $\mathbf{12_4}$). The displacement elements ($\mathbf{12_1}$, $\mathbf{12_2}$, $\mathbf{12_3}$, $\mathbf{12_4}$) are connected via coupling members (16) to a pattern controlled adjusting device (18) and can be adjusted between a basic position and a switched position. In order to improve the warp knitting machine, the adjusting device (18) is constructed as a negative dobby or Jacquard machine operating by the double-lift method and the displacement elements are pretensioned in one position.

16 Claims, 3 Drawing Sheets

WARP KNITTING MACHINE, ESPECIALLY CROCHET GALLOON MACHINE

BACKGROUND OF THE INVENTION

The invention is directed to a warp knitting machine, particularly crochet galloon machine with at least one control arrangement for the shifting movement of at least one guide bar which is pretensioned against a pick-off gear, which contains a plurality of thrust elements arranged one after the other and supported at radial cams (34, 60) of displacement elements of different displacement steps with the displacement elements adjustable, between a basic position and a switched position, via coupling members by an adjusting device which can be controlled by a pattern.

Such a warp knitting machine is known e.g. from DE-PS 467 899. A Jacquard mechanism serves as adjusting device and the displacement elements are actuated by change-over levers having two high and two low stops located opposite one another. In correspondence with the Jacquard card, these stops are brought into the area of stop bars, which oscillate one within the other cyclically, in such a way that the displacement elements are adjusted according to pattern and fixed at the end of the switching lift. A great disadvantage consists in that the Jacquard needles, and accordingly the displacement elements, must execute a complete working stroke or lift, i.e. a complete reciprocating movement, for every revolution of the warp knitting machine. This causes the displacement elements to be reciprocated suddenly between the thrust elements and the guide bar accordingly also changes position suddenly. This causes great stress on all mechanical parts and damaging and noisy bouncing effects result. Such a warp knitting machine not only has a complicated construction, but is subjected to high wear and produces considerable noise. Accordingly, the warp knitting machine can also only be moved at relatively slow speeds.

DE-PS 31 17 683 describes another warp knitting machine of the type mentioned in the beginning, each adjusting device having an eccentric which is rotatable by 180° when controlled and connected with a displacement element by a positive-locking coupling member. This displacement element is constructed as a roller which can be displaced along a radial cam arranged at a thrust element. A disadvantage of this arrangement consists in that the adjusting device must execute a complete work lift, i.e. a reciprocating movement, during a revolution. The performance of this warp knitting machine is accordingly likewise limited.

SUMMARY OF THE INVENTION

It is the object of the invention to construct a warp knitting machine of the type mentioned in the beginning in such a way that it enables a higher output with a simple construction.

This object is met according to the invention by the construction of the adjusting device as a negative dobby or Jacquard machine operating by the double-lift method and connected via the coupling members with displacement elements which are pretensioned in one position. Simple construction is provided in that the adjusting device is constructed as a negative dobby or Jacquard machine operating by the double-lift method, since the adjusting device need only ensure the displacement of the displacement element in one direction, while adjustment is effected in the other direction by means of a pretensioning force. The double lift means that two drive elements acting in a counter-cyclical manner act on the coupling member via a connecting link in such a way that every drive element need execute only one lift per revolution of the warp knitting machine to actuate the coupling link. Accordingly, such a warp knitting machine can be operated at a substantially higher drive speed and a gentle movement of the displacement elements is nevertheless effected. This results in higher speeds of the warp knitting machine with a simultaneous decrease in wear and reduced noise.

Such negative dobby or Jacquard machines operating by the double-lift method are known e.g. from Hans Walter Kipp, "Ribbon Weaving [Bandwebtechnik]", Frick 1988, pages 47 to 77.

The adjusting device for every coupling member has two driven tension elements, which can be reciprocated in translational movement between two end position in a counter-cyclical manner and which are connected with one another by a connecting member at which the coupling member is connected. A stationary fixing member is associated with every tension element and fixes the associated tension element in one end position as desired, depending on the control program. The connecting member is guided around a deflecting roller at which the coupling member is connected and which is displaceable in the movement direction of the coupling member. The tension elements are constructed in a rod-shaped manner and cooperate with guide devices which are effective substantially in the displacement direction of the deflecting roller. A retaining hook, which is rotatable around a stationary axis between a release position and a working position, is associated with every tension element as a fixing member and is intended to engage, in its working position, in hooks provided at the tension elements.

Every tension element is guided through the associated guide device in a displaceable manner and has a stop, which cooperates with the guide device, and every retaining hook is held in its working or release position by a spring acting against electromagnets. Every retaining hook is constructed as a magnet armature of the associated electromagnets, and is connected with a resetting device, which is intended to bring the retaining hook into contact at the electromagnets against the action of the spring depending on the control program.

The coupling members are constructed as flexible tension members which are guided via deflecting rollers, if necessary.

The displacement elements are movable transversely relative to the displacement direction of the thrust elements, and the radial cams are formed by a first portion with a width ($B_1$), a transition portion and a second portion of a greater width ($B_2$). The radial cam is preferably arranged at one side of the displacement element and the other side is constructed so as to be straight. The displacement elements are constructed as swivel members whose swivel axes are arranged in the displacement path of the thrust elements and whose radial cams are formed by a first portion with a radius ($R_1$), a transition portion, and a second portion with a greater radius ($R_2$), with the basic position being associated with the first portion of the displacement elements.

A restoring spring acts on the displacement elements against the positive-locking movement direction of the adjusting device. The restoring spring acts on the opposite side of the point of application of the coupling member at the displacement element. The displacement element with the radial cam is movable from the basic position into the switched position in a positive-locking manner and from the switched position into the basic position in a force-locking manner, with the basic position corresponding to the narrow region of the displacement element.

The thrust elements are supported at the radial cams of the displacement elements via driver rollers, and/or are guided by means of rollers in a guide.

BRIEF DESCRIPTION OF THE DRAWINGS

Embodiment examples of the warp knitting machine according to the invention are described in more detail in the following with reference to schematic drawings wherein.

DETAILED DESCRIPTION OF THE PREFERRED EMBODIMENTS

Figure 1:
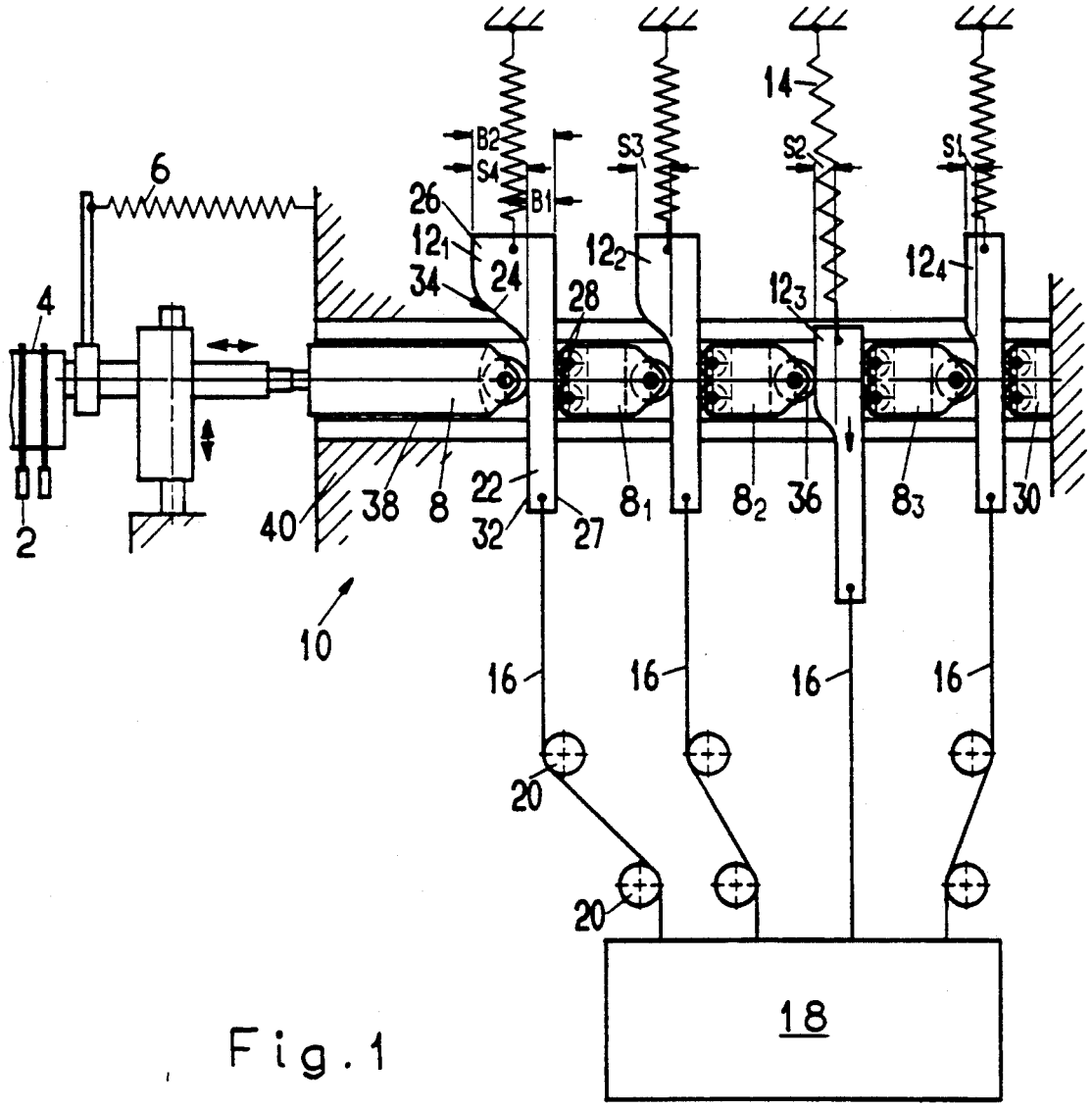
FIG. 1 shows a first control arrangement for the shifting movement of a guide bar in the warp knitting machine as seen transversely relative to the longitudinal axis of the guide bar.

FIG. 1 shows a section from a warp knitting machine, specifically a control arrangement for the shifting movement of a guide bar 4 provided with thread guides 2. The guide bar 4 is pretensioned by a pull-back spring 6 against a thrust element 8 of a pick-off gear 10. The latter contains displacement elements $\mathbf{12}_1$, $\mathbf{12}_2$, $\mathbf{12}_3$, $\mathbf{12}_4$ which are arranged between thrust elements 8, $\mathbf{8}_1$, $\mathbf{8}_2$, $\mathbf{8}_3$ and pretensioned by springs 14 in one position. The displacement elements 12 are connected at the ends located opposite the springs 14 via coupling members 16 in the form of flexible tension members with an adjusting device 18 which can be controlled according to pattern. The coupling members 16 can be guided either in a continuous straight-line or via deflecting rollers 20.

The adjusting device, which is not shown in more detail, is a negative dobby or Jacquard machine operating by the double-lift method as is described e.g. in Hans Walter Kipp, "Ribbon Weaving [Bandwebtechnik]", Frick 1988, pages 47 to 77.

Each displacement element $\mathbf{12}_1$, $\mathbf{12}_2$, $\mathbf{12}_3$, $\mathbf{12}_4$ contains a first portion 22 of width $B_1$ which merges into a second portion 26 of greater width $B_2$ via a transition portion 24. The displacement elements $\mathbf{12}_1$, $\mathbf{12}_2$, $\mathbf{12}_3$, $\mathbf{12}_4$ are arranged in a straight line on one side, the last displacement element $\mathbf{12}_4$ being supported at rollers 28 of a stationary element 30, while the rest of the displacement elements $\mathbf{12}_1$, $\mathbf{12}_2$, $\mathbf{12}_3$ are supported at rollers of thrust elements 8, $\mathbf{8}_1$, $\mathbf{8}_2$, $\mathbf{8}_3$ in each instance. The side 32 located opposite the straight side 27 forms a radial cam 34 based on the first portion 22, the transition portion 24 and the second portion 26. A driver roller 36 of an adjacent thrust element 8, $\mathbf{8}_1$, $\mathbf{8}_2$, $\mathbf{8}_3$ is supported at the radial cam 24. The thrust elements 8, $\mathbf{8}_1$, $\mathbf{8}_2$, $\mathbf{8}_3$ are movably supported in a guide 38 of the machine frame 40.

The difference between widths $B_2$ and $B_1$ of the second portion 26 and first portion 22 of the displacement elements $\mathbf{12}_1$, $\mathbf{12}_2$, $\mathbf{12}_3$, $\mathbf{12}_4$ corresponds to the displacement steps $S_1$, $S_2$, $S_3$, $S_4$, whose magnitudes correspond to the geometrical series 1:2:4:8:. In the example, the displacement elements $\mathbf{12}_1$, $\mathbf{12}_2$ and $\mathbf{12}_4$ are in the basic position in which they are pretensioned by means of recuperating or restoring springs 6. The displacement element $\mathbf{12}_3$ is located in the second position, the control position, in which it has shifted the parts of the pick-off gear lying in the direction of the guide bar as well as the guide bar itself by displacement step $S_3$. Numerous shifted positions of the guide bar can accordingly be adjusted by optional activation of the displacement elements $\mathbf{12}_1$, $\mathbf{12}_2$, $\mathbf{12}_3$ and $\mathbf{12}_4$.

Figure 2:
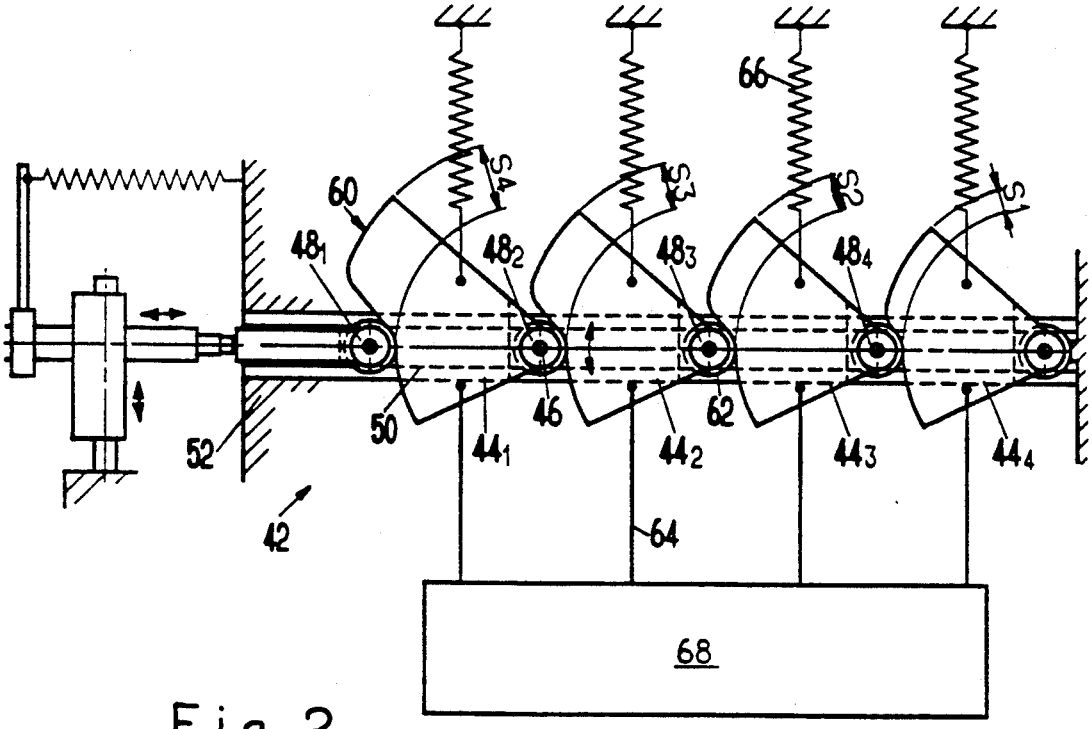
FIG. 2 shows a second control arrangement for the shifting movement of a guide bar of the warp knitting machine as seen transversely relative to the longitudinal axis of the guide bar.
Figure 3:
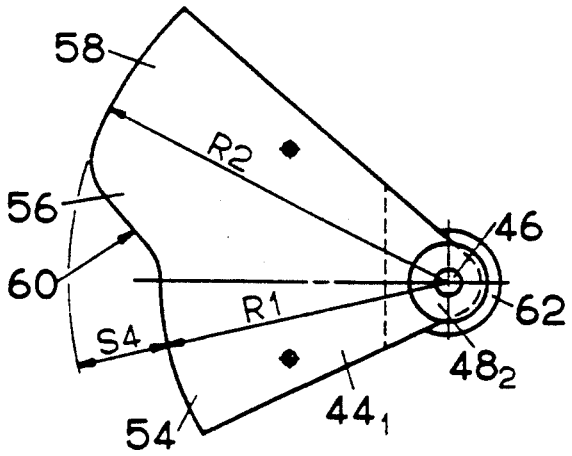
FIG. 3 shows a displacement element of the control arrangement of FIG. 2.
Figure 4:
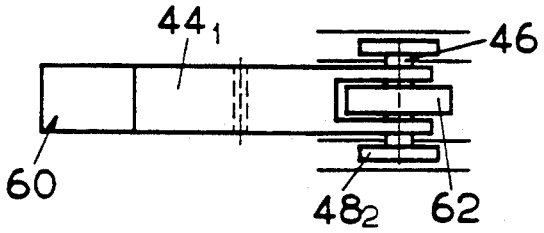
FIG. 4 shows the displacement element of FIG. 3 as seen from the top.

FIGS. 2 to 4 show a section from a warp knitting machine with an additional pick-off gear 42 in which the displacement elements $\mathbf{44}_1$, $\mathbf{44}_2$, $\mathbf{44}_3$, $\mathbf{44}_4$ are constructed in each instance as swivel members whose swivel axes 46 lie in the displacement path of the thrust elements $\mathbf{48}_1$, $\mathbf{48}_2$, $\mathbf{48}_3$, $\mathbf{48}_4$. In this example the thrust elements are reduced to guide rollers which are guided in a guide 50 of the machine frame 52. The displacement element has a first portion 54 with radius $R_1$ which merges into a second portion 58 with a greater radius $R_2$ via a transition portion 56. The portions 54, 56, 58 form a radial cam 60 at which a driver roller 62 of the thrust element $\mathbf{48}_1$, $\mathbf{48}_2$, $\mathbf{48}_3$, $\mathbf{48}_4$ lying in front of it is supported. The driver roller 62 is supported on the swivel axis 46 of the thrust elements as follows particularly from FIGS. 3 and 4. The displacement elements $\mathbf{44}_1$, $\mathbf{44}_2$, $\mathbf{44}_3$, $\mathbf{44}_4$ can be swiveled out of the basic position shown in FIG. 2, in which the driver rollers 62 contact the first portion 54 of the displacement elements $\mathbf{44}_1$, $\mathbf{44}_2$, $\mathbf{44}_3$, $\mathbf{44}_4$, into the switched position in which the driver rollers 62 contact the second portion 58 of the displacement elements in that the displacement elements are swiveled against the restoring spring 66 by means of coupling members 64.

Figure 5:
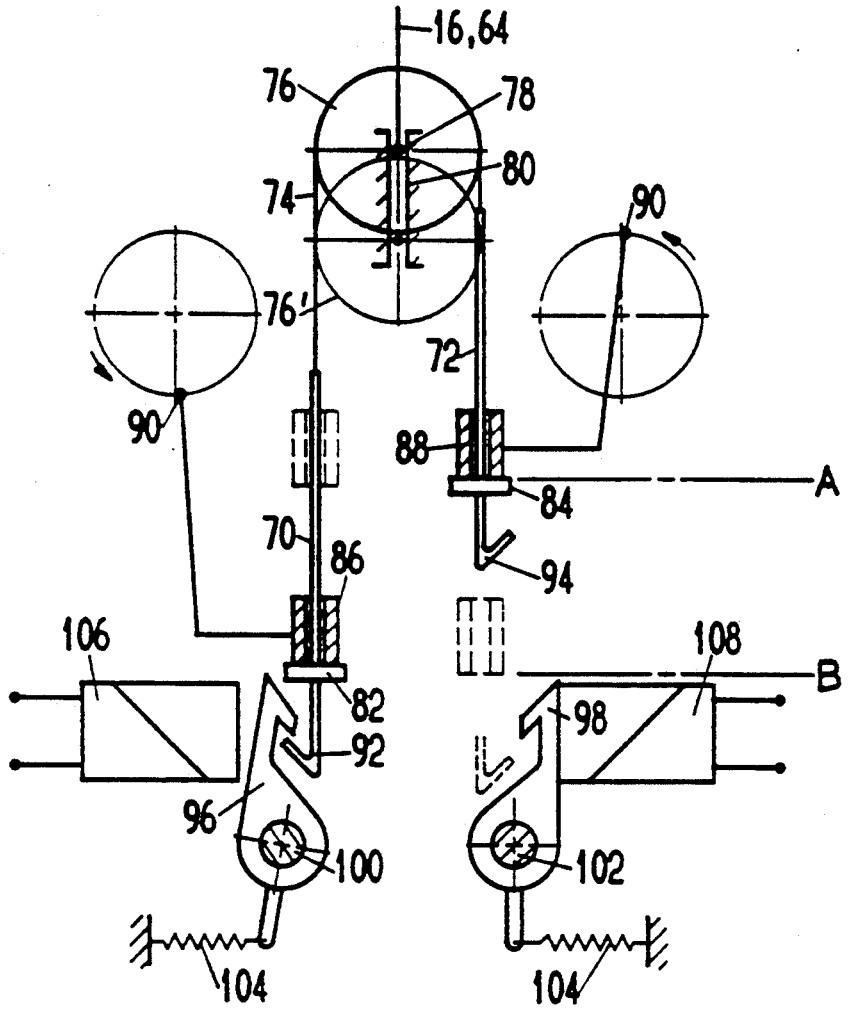
FIG. 5 shows a section from an adjusting device for the control arrangement.

FIG. 5 shows a section from a preferred adjusting device 18, 68 for a displacement element. This displacement element has two tension elements 70, 72 which can be reciprocated in translational movement between end positions in a counter-cyclical manner and are connected with one another via a connecting member 74. This connecting member 74 runs over a deflecting roller 76 whose axis 78 is guided in a stationary guide 80 in a reciprocating manner.

A coupling member 16, 64 for the displacement elements of the pick-off gear 10, 42 of FIGS. 1 and 2 is connected at the axis 78. A stop 82, 84 is fastened at each tension element 70, 72 and cooperates with guide devices 86, 88 which are driven in a reciprocating manner. The latter are moved by driven crank pins 90. Each guide device 86, 88 is provided with an opening through which the tension element 70, 72 is guided. Each of the guide devices cooperates with the associated stop so that the forces exerted on the stop by the guide device act symmetrically and no force components acting transversely to the movement direction of the tension elements occur. A hook 92, 94 which cooperates with stationary retaining hooks 96, 98 is associated with each tension element at the free end. The retaining hooks 96, 98 are supported so as to be rotatable around stationary axes 100, 102 and are connected with a spring 104, 106 which holds the associated retaining hook 96, 98 in a working position in which the retaining hook 96, 98 can engage behind the hook 92, 94 of the tension element 70, 72, fixing the tension element in the corresponding position. The retaining hooks 96, 98 are constructed as armatures of electromagnets 106, 108. When the electromagnets are excited by a feed source of a pattern device, not shown, the retaining hooks 96, 98 are attracted and moved out of their working position into a release position in which they no longer cooperate with the hooks of the tension elements 70, 72. It can readily be seen that the arrangement can also be carried out by means of corresponding constructional measures in such a way that the retaining hooks 96, 98 are held in the release position by means of their springs 104 and can be brought into a working position by means of the electromagnets 106, 108.

The guide devices 86, 88 which are driven in the manner of a pendulum between the two end positions in a counter-cyclical manner move the hooks 92, 94 between two positions A and B, likewise in a counter-cyclical manner, until the retaining hooks 96, 98 are held in their release position. During the movement of the guide devices 86, 88 from position A into position B, the latter rest on the stops 82, 84 and cause a movement of the tension elements 70, 72 against the retaining hooks 96, 98. When the guide devices 86, 88 move from position B into position A, the tension elements 70, 72 are moved back by the force exerted on the deflecting roller 76 by means of the coupling members, provided they are not fixed by the retaining hooks associated with them. When the tension elements 70, 72 are moved in a reciprocating manner between the two end positions in a counter-cyclical manner as described, the deflecting roller 76 remains under the influence of the spring force of the coupling members in their end position shown in the drawing.

If one of the electromagnets, e.g. electromagnet 106, is not excited at the moment that the associated hook 92 is in its lower end position, the retaining hook 96 is restored by the action of the spring 104 to its working position in which the retaining hook 96 fixes the hook 92 of the tension element 70 in position. If the other hook 94 is moved against the retaining hook 98 in the described manner in the next work cycle, the deflecting roller 76 is moved into position 76', shown in dashed lines in FIG. 5, with its axis 78 in the guide 80 against the pretensioning force of the coupling member so that the coupling member and the respective displacement element are shifted from the basic position into the switched position. The deflecting roller 76 now remains in its lower position 76' until the hooks 92, 94 are locked with the retaining hooks 96, 98.

The excitation and de-excitation of the electromagnets 106, 108 and accordingly the control of the retaining hooks 96, 98 and, consequently, of the tension elements 70, 72 are effected optionally by means of the control program of a pattern device, not shown in more detail, based on the position of the guide bar determined by the desired placement of the thread. Such a control program can be effected in a known manner, e.g. in the form of a punched card, a magnetic recording on magnetic tape, or by means of the pattern storage of a computer.

LIST OF REFERENCE NUMBERS

2 thread guide
4 guide bar
6 pull-back spring
8 thrust element
$8_1$ thrust element
$8_2$ thrust element
$8_3$ thrust element
10 pick-off gear
$12_1$displacement element
$12_2$ displacement element
$12_3$ displacement element
$12_4$ displacement element
14 pretensioning spring
16 coupling member
18 adjusting device
20 deflecting roller
22 first portion with $B_1$
24 transition portion
26 second portion with $B_2$
27 straight side
28 rollers
30 element
32 side
34 radial cam
36 driver roller
38 guide
40 machine frame
42 pick-off gear
$44_1$ displacement element
$44_2$ displacement element
$44_3$ displacement element
$44_4$ displacement element
46 swivel axis
$48_1$ thrust element
$48_2$ thrust element
$48_3$ thrust element
$48_4$ thrust element
50 guide
52 machine frame
54 first portion with $R_1$
56 transition portion
58 second portion with $R_2$
60 radial cam
62 driver roller
64 coupling member
66 restoring spring
68 adjusting device
70 tension element
72 tension element
74 connecting member
76 deflecting roller
78 axis
80 guide
82 stop
84 stop
86 guide device
88 guide device
90 crank pin
92 hook
94 hook
96 retaining hook
98 retaining hook
100 axis
102 axis
104 spring
106 electromagnet
108 electromagnet

I claim:

1. A control arrangement for use in a warp knitting machine having at least one guide bar, for controlling a shifting movement of the guide bar, said control arrangement comprising:

a pick-off gear having a plurality of thrust elements arranged one after another;

means for continuously pretensioning the guide bar against said pick-off gear;

a plurality of displacement elements corresponding in number to a number of displacement steps for adjusting shifted positions of the guide bar, said plurality of displacement elements including a plurality of radial cams, respectively, for supporting said plurality of thrust elements;

a device for adjusting said plurality of displacement elements between a basic position and a switched position thereof, said adjusting device comprising a negative Jacquard machine operating by a double-lift method;

a plurality of coupling flexible tension members for connecting said adjusting device with said plurality of displacement elements; and means for pretensioning said plurality of displacement elements to the basic position thereof.

2. A control arrangement as set forth in claim 1, wherein said adjusting device comprises two driven tension elements, which transversely reciprocate between two end positions thereof, for each of said coupling members, and a member for connecting said two tension elements, said coupling member being connected with said connecting member, said control arrangement further comprising two stationary fixing members for fixing said two tension members, respectively, in one of the two end positions thereof in accordance with a control program.

3. A control arrangement as set forth in claim 2, further comprising a deflecting roller for guiding said connecting member and for connecting said coupling member with said connecting member, said deflecting roller being displaceable in a movement direction of said coupling member, and guide devices for guiding said tension elements, each of said tension elements comprising a rod-shaped member having a hook at an end thereof remote from said connecting member, and each of said fixing members comprising a retaining hook rotatable around a stationary axis and cooperating with hook of a respective rod-shaped member in a working position of said retaining hook.

4. A control arrangement as set forth in claim 3, wherein said adjusting device further comprises two stops cooperating with respective guide devices.

5. A control arrangement as set forth in claim 3, further comprising springs for holding said retaining hooks, respectively, in one of working and release positions of respective retaining hooks, and electromagnets acting on said retaining hooks, respectively, in a direction opposite to a direction of a biasing force of said springs.

6. A control arrangement as set forth in claim 5, wherein each retaining hook is formed as a magnet armature of an associated electromagnet.

7. A control arrangement as set forth in claim 6, comprising resetting means for bringing a respective retaining hook into contact with the associated electromagnet against the biasing force of a respective spring in accordance with the control program.

8. A control arrangement as set forth in claim 1, wherein said displacement elements move transversely to a displacement direction of said thrust elements, and wherein each displacement element has a first portion having a first width and forming a radial cam, a transition portion, and a second straight portion having a second width greater than the first width.

9. A control arrangement as set forth in claim 1, wherein said displacement elements are formed as swivel members having their swivel axes arranged in displacement path of said thrust elements, and having each a first portion with a first radius forming a radial cam and a second portion having a second radius greater than the first radius.

10. A control arrangement as set forth in claim 8, wherein the basic position of said displacement elements is defined by the first portions thereof.

11. A control arrangement as set forth in claim 9, wherein the basic position of said displacement elements is defined by the first portions thereof.

12. A control arrangement as set forth in claim 1, wherein said pretensioning means acts in a direction opposite to a direction of a positive-locking movement of said adjusting device.

13. A control arrangement as set forth in claim 12, wherein said pretensioning means comprises a plurality of restoring springs corresponding in number to the number of said displacement elements, each of the restoring springs acting on a side of a respective displacement element opposite to a side of the displacement element on which a respective coupling member acts.

14. A control arrangement as set forth in claim 11, wherein each radial cam moves the basic position of the respective displacement member into the switched position thereof in a positive locking manner, and from the switched position into the basic position in a force-locking manner.

15. A control arrangement as set forth in claim 1, further comprising a plurality of driver rollers for supporting said thrust elements on said radial cams, respectively.

16. A control arrangement as set forth in claim 1, comprising a guide and a plurality of rollers for guiding said thrust elements in said guide, respectively.

* * * * *